US005673529A

United States Patent [19]

Treister et al.

[11] Patent Number: 5,673,529

[45] Date of Patent: Oct. 7, 1997

[54] STONE CLADDING SYSTEM

[76] Inventors: Kenneth Treister, 3660 Battersea Rd., Coconut Grove, Fla. 33133; Yehuda Mizrahi, 21/17 Kadima Street, Jerusalem, Israel

[21] Appl. No.: 503,927

[22] Filed: Jul. 19, 1995

[30] Foreign Application Priority Data

Jul. 20, 1994 [IL] Israel ..... 11041

[51] Int. Cl.[6] ..... E04B 2/88

[52] U.S. Cl. ..... 52/511; 52/235; 52/512; 52/513

[58] Field of Search ..... 52/235, 511, 513, 52/508, 509, 512

[56] References Cited

U.S. PATENT DOCUMENTS

| | | | |
|---|---|---|---|
| 507,430 | 10/1893 | Graham | 52/509 X |
| 2,223,721 | 12/1940 | Ernstoff | 52/509 X |
| 3,019,560 | 2/1962 | Hansen | 52/513 X |
| 3,142,938 | 8/1964 | Eberhardt | 52/511 X |
| 3,462,901 | 8/1969 | Jamgochian | 52/235 X |
| 3,826,055 | 7/1974 | Bobzin et al. | 52/512 X |
| 4,606,160 | 8/1986 | Kubbutat | 52/235 |
| 4,799,346 | 1/1989 | Bolton et al. | 52/509 |
| 5,058,354 | 10/1991 | Menchetti | 52/511 |
| 5,301,484 | 4/1994 | Jansson | 52/511 X |

FOREIGN PATENT DOCUMENTS

| | | | |
|---|---|---|---|
| 23068 | 3/1936 | Australia | 52/513 |
| 2142780 | 3/1973 | Germany | 52/509 |
| 2348072 | 4/1975 | Germany | 52/235 |

*Primary Examiner*—Carl D. Friedman
*Assistant Examiner*—Laura A. Saladino
*Attorney, Agent, or Firm*—Malloy & Malloy, P.A.

[57] ABSTRACT

A wall cladding system to provide an attractive finished, exterior appearance to a building wall, the system including an assembly of adjacent, similar, thin cladding elements, oriented in a substantially vertical plane, each cladding element including an exterior panel provided with an exterior and an interior major face, the interior major face being attached by an adhesive material to a flexible sheet of material having an upper edge projecting beyond the cladding element. Further, a plurality of spaced-apart fasteners are provided to connect the flexible sheet of material to a building wall.

6 Claims, 3 Drawing Sheets

STONE CLADDING SYSTEM

BACKGROUND OF THE INVENTION

1. Field of the Invention

The present invention relates to a system for cladding building walls safely, attractively, and cost effectively.

2. Description of the Related Art

Wall cladding is carried out on buildings to meet a number of design objectives. The durability provided is the prime requirement in facing walls made of foamed plastic materials or light-weight cement blocks, and the improvement of the appearance and compliance with local building codes is the prime requirement for concrete walls. Additionally, wall cladding always provides improved thermal and acoustic insulation and better weather resistance.

Many buildings, even today, are built using simple rectangular slabs as facing blocks. Those blocks are anchored and attached to each other by a layer of cement at the rear of and between the edges of the blocks. During construction, wedges are inserted under each block to ensure that there is room for cement, these wedges being removed, at least in part, after a layer of cement has been inserted between courses and dried. Not only is this system slow and wasteful, it has also been found to be dangerously unreliable for tall buildings, which tend to sway slightly due to wind pressure and minor earth tremors, resulting in the loosening of facing blocks that can cause injury or death to persons in the vicinity of such buildings. In some cities throughout the world, as a result of a very dangerous fall of a number of facing blocks from clad buildings to pedestrian areas, the municipalities have forced the owners of such buildings to take emergency action to secure cladding blocks thereto. Such emergency methods are, however, expensive and disruptive of normal activities and as such, it is, of course, far better to properly secure the facing blocks during construction.

Several methods of properly securing facing blocks are known. Some such systems require grooves in the lower and upper edges of each stone, into which a connecting element in the form of a cross is inserted. Further, these types of systems requires the use of planking and do not become permanently stable until concrete is poured behind the facing blocks. Even systems which do not, however, require the pouring of concrete behind the facing blocks are difficult to incorporate and do not lend themselves to fast construction by unskilled workmen.

Some known systems utilize dry cladding with bridging members as brackets. These systems, however, require the individual attachment of each bridging bracket to the wall being faced, an arrangement requiring some skill and consuming considerable time during construction.

Many other cladding systems are also known, each having some advantages and limitations.

Further, many known cladding systems are unable to retain their outer panels during an earthquake. Cladding systems are generally not required to withstand an earthquake of greater severity than that which would destroy the wall to which they are attached; however, the release of cladding panels during a more moderate earthquake is all to frequent and is unacceptable in the many known locations where earthquakes occur regularly.

SUMMARY OF THE INVENTION

It is an object of the present invention to provide a cladding system having good resistance to possible earthquakes, while providing for facilitated construction and an extremely decorative appearance.

The present invention provides this through a wall cladding system comprising an assembly of adjacent, similar, thin cladding elements, oriented in a substantially vertical plane. Each cladding element includes an exterior panel provided with an exterior and an interior major face. The interior major face is attached by means of an adhesive material to a flexible sheet of material having an upper edge projecting beyond the cladding element. Further, a plurality of spaced-apart fasteners are provided to connect the flexible sheet of material to a building wall.

Preferably, the sheet of material is a woven or non-woven mesh of natural or artificial fiber, and especially preferred is a woven mesh of steel wires or plastic netting.

A further object of the present invention is to make suitable provision for heat insulation. This is achieved by providing, in a preferred embodiment, a wall cladding system wherein a heat-insulating space is provided between the cladding element and the building wall with the fastener passing through the strip.

Many known cladding systems make no provision for vertical alignment of the outer panels where the wall to which they are to be attached is not perfectly vertical. Thus, yet a further object of the present invention is to make such provision for this eventuality by providing in a preferred embodiment a wall cladding system further including an axially-compressible tube element between the strip and an edge of the sheet of material contacting an irregular building wall, the fastener passing through the tube element, whereby a plurality of the cladding elements may be aligned to form a vertical plane by appropriate tightening of their respective fasteners to compress the tube elements to a required axial length.

Since fast on-site construction as well as strict quality control can best be achieved by the use of pre-fabricated wall sections, it is a further object of the present invention to provide such a section so as to achieve all the known advantages of this form of construction. Accordingly, in a further preferred embodiment of the present invention there is provided a pre-fabricated cladded building wall section, including at least two adjacently-aligned thin cladding panels, each panel being provided with an exterior and an interior major face. The interior major face is attached by means of an adhesive material to a flexible sheet of material which projects beyond the cladding panel. Additionally, two flexible sheets of material from adjacent panels are clamped together in a gripper channel. The gripper channel is retained by concrete cast therearound, the concrete forming a part of the building wall section.

BRIEF DESCRIPTION OF THE DRAWINGS

For a fuller understanding of the nature of the present invention, reference should be had to the following detailed description, taken in connection with the accompanying drawings in which.

DETAILED DESCRIPTION OF THE PREFERRED EMBODIMENT

Figure 1:
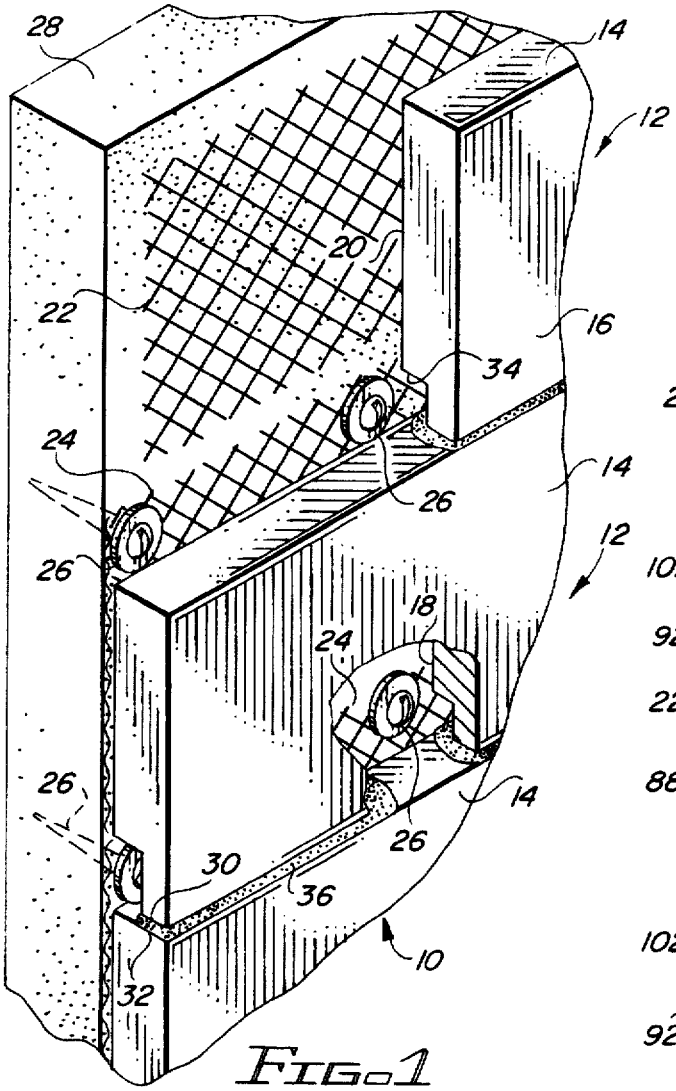
FIG. 1 is a perspective fragmented view of a preferred embodiment of the wall cladding system according to the invention.

The present invention is directed towards a wall cladding system, generally indicated as 10. As shown in FIG. 1, the wall cladding system 10 includes an assembly of adjacent similar thin cladding elements 12 oriented in a substantially vertical plane. Each element 12 includes at least one outer panel 14, provided with an exterior 16 and an interior major face 18. Panels 14 are typically made of stone, marble, a ceramic tile, a light-weight air bubble concrete or aluminum.

The interior major face 18 of at least one, but usually several panels 14 is attached by means of an adhesive material 20 to a flexible sheet of material 22. The face 18 is optionally provided with small grooves (not shown) to improve adhesion thereto.

A suitable sheet of material 22 comprises a metal screen made of 0.6 steel wire at 12 mm pitch. As the sheet of material 22, when in use, is protected from weathering, a plastic netting may be used instead of steel.

The adhesive material 20 typically comprises an epoxy adhesive. Lower costs can, however, be achieved both in adhesive cost and in requiring less surface preparation by using either a second generation modified acrylic adhesive or a polyurethane adhesive.

An upper edge 24 of the sheet of material 22 projects beyond, and preferably above, the cladding element 12. Further, a plurality of spaced-apart fasteners 26 are provided to attach the flexible sheet of material 22 to a building wall 28. The type of fastener 26 used will depend on whether the wall 28 is made of concrete as shown or whether the wall 28 is a steel structure or made of wood.

In the embodiment shown, the lower edge of the panel 30 is sloped for improved retention against a similarly sloped upper edge 32 of a panel 14 positioned thereunder. Further, the embodiment shown has a recess 34 in the panel 14 for the head of the fastener 26, and a mortar material 36 is shown as used between courses of panels 14 to prevent water ingress.

Figure 2:
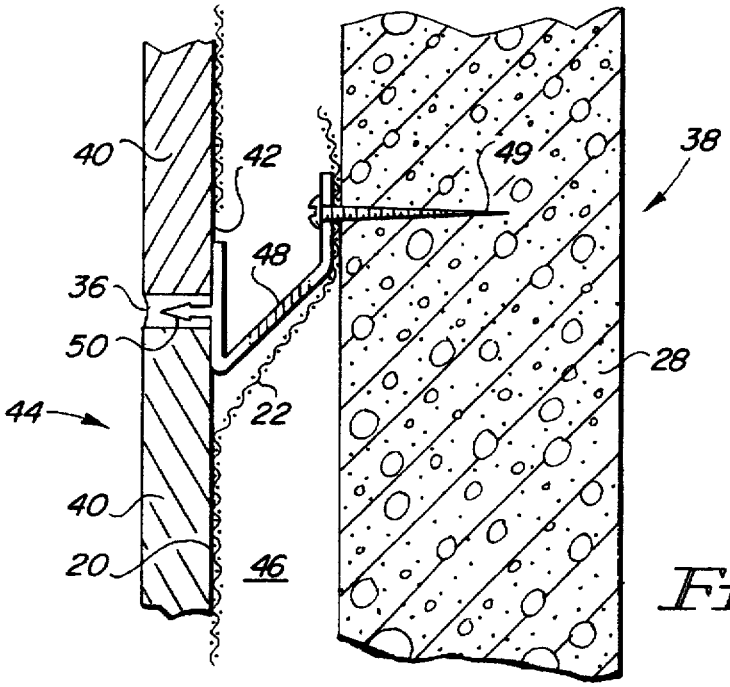
FIG. 2 is an end view of a heat insulating embodiment of the system.

Referring now to FIG. 2, there is seen a heat insulating embodiment 38 of the wall cladding system. In this embodiment, outer panels 40, with an interior major face 42 are attached by means of an adhesive material 20 to a flexible sheet of material 22 to form a cladding element 44. A heat-insulating space 46 is provided between the cladding element 44 and the building wall 28. Specifically, the space 46 is too narrow to allow substantial air movement and, as is known, non-mobile air is an excellent heat insulator.

A shaped profile strip 48—as for example, an aluminum extrusion—supports the cladding element 44 in spaced-apart relationship with the building wall 28. Fasteners 49 pass through the strip 48 to secure the cladding element 44 at a fixed distance from the wall 28. The profile strip 48 shown is provided with an arrow-shaped extension 50 which is gripped by the mortar material 36, thus providing further security against outward separation of the panels 40 from contact with the profile strip 48.

Figure 3:
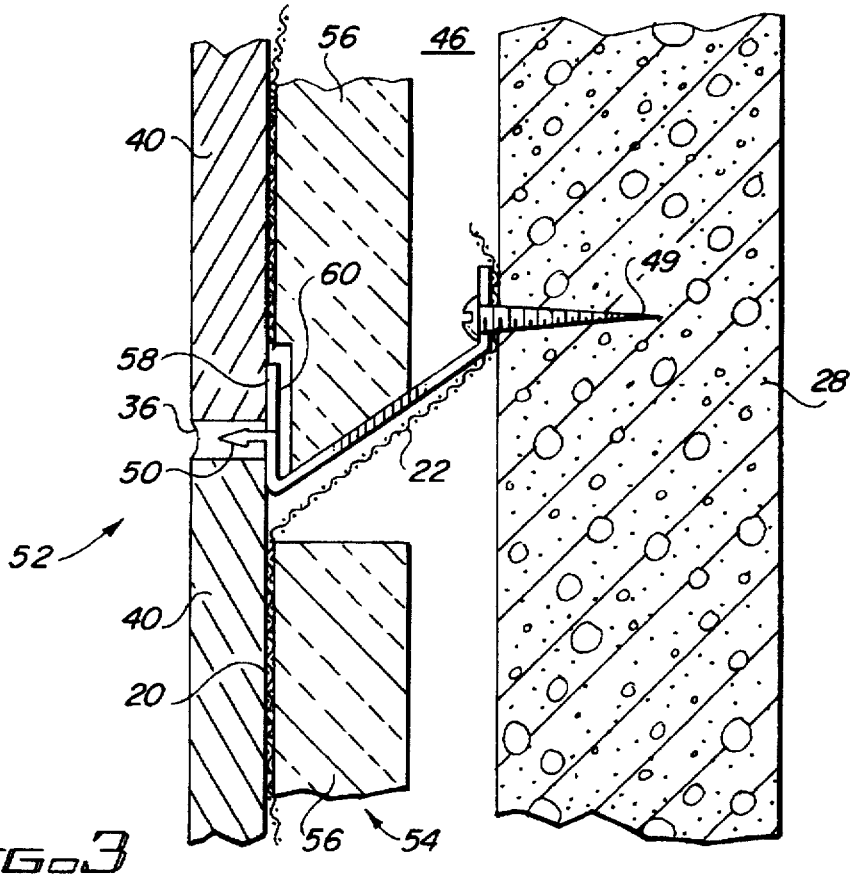
FIG. 3 is an end view of a second heat insulating embodiment of the system.

Turning to FIG. 3, it shows a further embodiment 52 of the wall cladding system wherein a part of the thickness of the heat-insulating space 46 is occupied by a heat-insulating material 54, such as foamed polystyrene or foamed polyurethane. Otherwise, this embodiment 52 is similar to the system 38 described in reference to FIG. 2.

Additionally, a heat insulating slab 56 in the space 46 is advantageously attached to the flexible sheet of material 22. Also, the shaped profile strip 58 is preferably provided with an open channel 60 to retain therein a lower edge of the heat-insulating slab 56.

Figure 4:
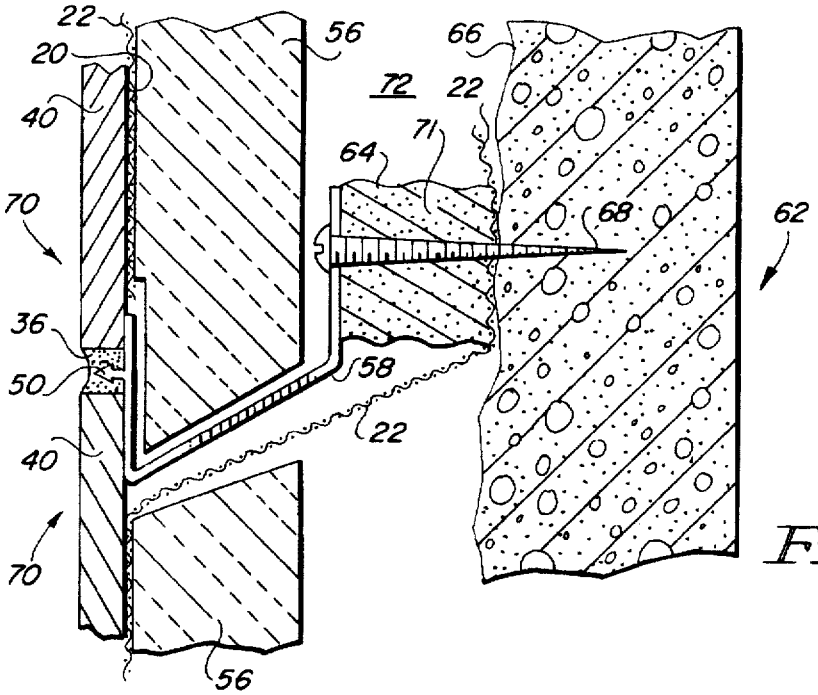
FIGS. 4 & 5 are end views of embodiments adapted for cladding uneven walls.

Looking to FIG. 4, shown is an embodiment 62 of the wall cladding system 62 having similarities to the system 52 shown in FIG. 3. However, there is further provided an axially-compressible tube element 64 between the shaped profile strip 58 and an edge of the sheet of material 22 contacting an irregular building wall 66.

The axially-compressible tube element 64 shown is bellow-shaped, and may be made of a plastic or metal. Further, a long fastener 68 passes through the tube element 64. In use, a plurality of cladding elements 70 are aligned to form a vertical plane by appropriate tightening of their respective fasteners 68, to compress each tube element 64 to a required axial length. Accordingly, by tightening some of the screws to varied degrees, the exterior plane formed by the cladding elements 70 will be uniform even though the underlying surface is rough and unlevel. Thereafter, the system can advantageously be further stabilized by injecting a liquid solid-setting material 71 such as cement or foamed polyurethane, into the compressed tube element 64 to provide rigidity and maintain the alignment thereof. An air gap 72 adjacent to the wall 66 provides additional insulation. The system 62 thus allows the construction of a flat vertical outer surface on a wall 66 which is irregular in form.

Figure 5:
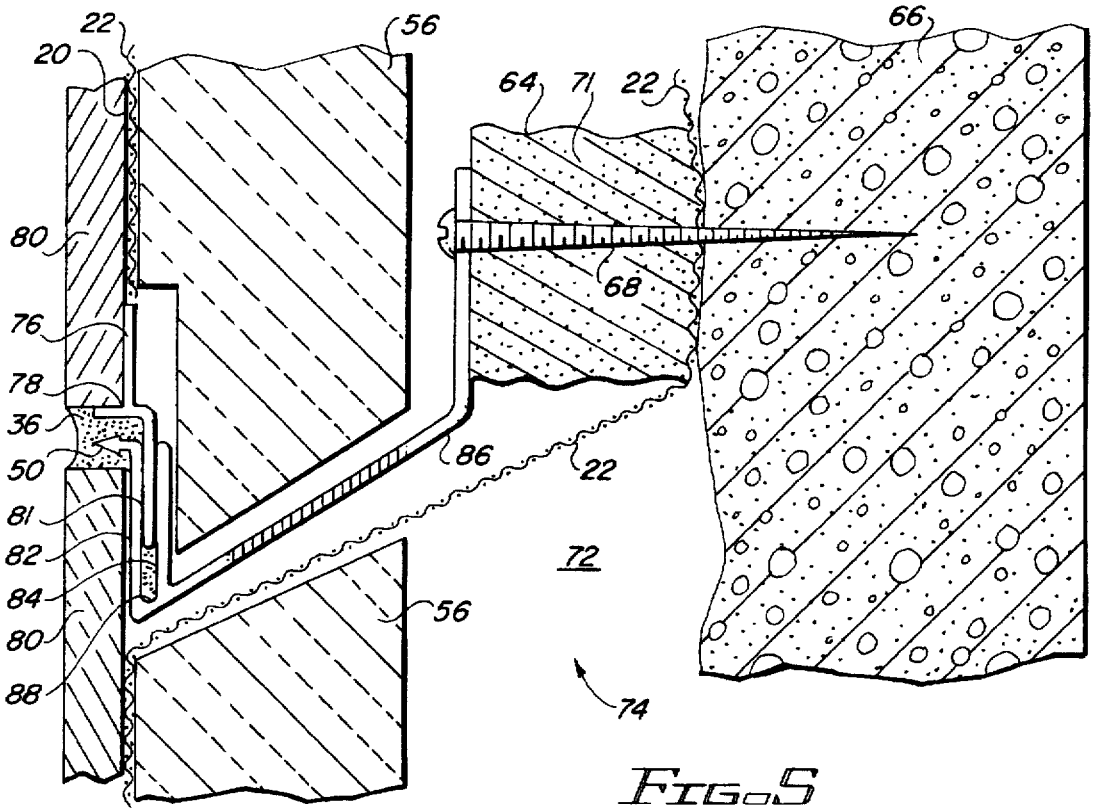

In FIG. 5, there is seen a further embodiment 74 of the wall cladding system, generally similar to the system 52 of FIG. 3. In this embodiment a lip profile 76, suitably made of a plastic extrusion or of any other material, envelops a lower inner corner 78 of a cladding element 80. The lip profile 76 is provided with a subtending leg 81 guided in a plane parallel to the major faces of the cladding element 80, between vertical walls 82, 84 or a shaped profile strip 86. The lip profile 76 provides a convenient means for sealing the joint between courses, in combination with sealant 88, suitably silicon-based, injected between the vertical walls 82, 84 and the subtending leg 81.

Figure 6:
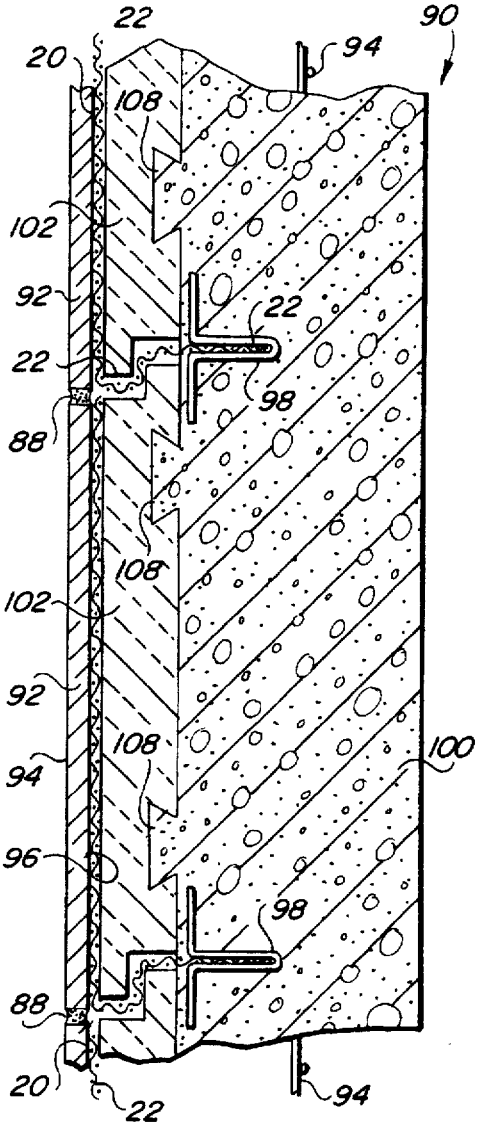
FIG. 6 is an end view of a pre-fabricated cladded building wall section.

FIG. 6 depicts a pre-fabricated cladded building wall section 90, comprising at least two adjacently-aligned thin cladding panels 92. A sealant 88, suitably silicon-based, is used between the panels 92. The wall section 90 can conveniently be room-sized, for example 4 meters by 2.8 meters, and include windows, doorways, conduits (not shown) and reinforcement rods 94.

Each panel 92 has an exterior 94 and an interior 96 major face, the interior major face 96 being attached by means of an adhesive material 20 to a flexible sheet of material 22, as described with reference to FIG. 1. The sheet of material 22 projects beyond the cladding panel 92, and two flexible sheets of material 22 from adjacent panels 92, or a fold of a single sheet of material sheet 22, are clamped together in a gripper channel 98, while the panels are adjacently aligned on a horizontal surface (not shown). The channel 98 is retained by concrete 100 cast therearound, while the panels are in the horizontal orientation. The concrete forms a part of the building wall section 90, which is then lifted and transported as a single unit once the concrete 100 has set. Further details of the channel are given with reference to FIG. 7.

In the preferred embodiment shown, an insulating material 102, such as a slab of foamed polystyrene or foamed polyurethane, is positioned between the sheet of material 22 and a surface of the concrete 100, and is formed as an integral part of the pre-fabricated panel during the casting of the cement 100.

Figure 7:
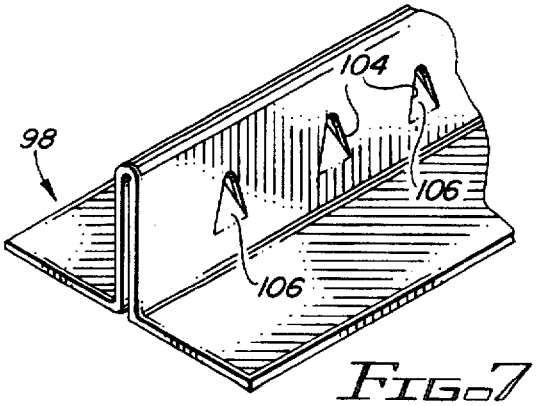
FIG. 7 is a perspective view of a preferred embodiment of a gripper channel, as used in the pre-fabricated embodiment shown in FIG. 6.

Seen in FIG. 7 is a preferred embodiment of the gripper channel 98. In this embodiment, several recesses 104 are provided, these being configured to allow entry to poured concrete 100, thus contacting and retaining the flexible sheet of material 22 held in the channel 98.

The recesses 104 are formed by a U-shaped cut in the metal, followed by bending the resultant tongue 106 inward. The tongue 106 allows passage to the sheet of material 22 pressed therein, but provides good resistance to a withdrawal force.

Regarding the gripper channel 98, it need not be longer than about 5 centimeters. Also, optionally, the foamed material 102 can be formed with dove-tailed grooves 108 so that the poured concrete 100 will better adhere thereto.

Alternatively, a more conventional tongue and groove interconnection between elements may be incorporated.

The various embodiments of the wall cladding system 10 are preferably structured to be secured to an exterior building wall face which is already part of the building. Alternatively, however, the system may be secured to any building wall element. For example, the element may include: (a) a building wall, such as one constructed on site, already installed or uninstalled pre-fab, (b) an individual building block which can be formed of a material such as concrete, foam, or cement, and be utilized for any purpose, such as structural, decorative or insulative, and (c) an interior or exterior building facade, divider or wall panel. Accordingly, pre-fabricated building elements can be provide with the cladding system pre-installed to further facilitate finished modular construction, and because of the capability to secure it to a variety of building wall elements the versatility of the insulative attractive finish is increased.

Regarding the attractive appearance, it is preferred that the exterior panel be formed of stone. Specifically, stone exterior buildings are substantially expensive and difficult to construct because each stone slab must be especially cut and is generally quite heavy and difficult to install. Generally, stone must be cut from a specific quarry and transported to the sight where it is carefully hung. Because of the thickness of stone necessary using conventional securing systems, the slabs are very heavy and very expensive. Accordingly, the present building cladding system is structured to utilize a substantially thin layer of stone as the exterior panel to provide the same attractive appearance and insulation as regular, all stone buildings, but at a considerably reduced cost and with much greater ease of installation.

It will be evident to those skilled in the art that the invention is not limited to the details of the foregoing illustrative embodiments, and that the present invention may be embodied in other specific forms without departing from the essential attributes thereof, and it is therefore desired that the present embodiments be considered in all respects as illustrative and not restrictive, reference being made to the appended claims, rather than to the foregoing description, and all changes which come within the meaning and range of equivalency of the claims are therefore intended to be embraced therein.

While this invention has been shown and described in what is considered to be a practical and preferred embodiment, it is recognized that departures may be made within the spirit and scope of this invention which should, therefore, not be limited except as set forth in the claims which follow and within the doctrine of equivalents.

What is claimed is:

1. A wall cladding system comprising:

an assembly of adjacent, similar, thin cladding elements oriented in a substantially vertical plane, each of said cladding element including an exterior panel provided with an exterior and an interior major face, said interior major face being attached to a flexible sheet of material, said flexible sheet of material having an upper edge projecting beyond said cladding element, a shaped profile strip supporting said cladding element in spaced-apart relationship with a building wall element and thereby defining a heat-insulated space between said cladding element and the building wall element, a plurality of spaced-apart fasteners structured to attach said cladding element to the building wall element, one of said fasteners passing through said shaped profile strip, and an axially-compressible tube element disposed between said shaped profile strip and said upper edge of said flexible sheet of material contacting the building wall element, said fastener passing through said tube element and said flexible sheet of material and into the building wall element, whereby a plurality of said cladding elements may be aligned to form said vertical plane by appropriate tightening of their respective fasteners to compress said tube element to a required axial length.

2. A wall cladding system as recited in claim 1, wherein at least a part of a thickness of said heat-insulating space is occupied by a heat-insulating material.

3. A wall cladding system as recited in claim 2, wherein said heat insulating material is attached to said sheet of material.

4. A wall cladding system as recited in claim 2, wherein said shaped profile strip is provided with an open channel retaining therein a lower edge of a heat-insulating slab.

5. A wall cladding system as recited in claim 1, further including a liquid solid-setting material which is injected into said compressed tube element to provide rigidity and maintain the alignment thereof.

6. A wall cladding system comprising:

an assembly of adjacent, similar, thin cladding elements oriented in a substantially vertical plane, each of said cladding element including an exterior panel provided with an exterior and an interior major face, said interior major face being attached to a flexible sheet of material, said flexible sheet of material having an upper edge projecting beyond said cladding element, a shaped profile strip supporting said cladding element in spaced-apart relationship with a building wall element and thereby defining a heat-insulated space between said cladding element and the building wall element, a plurality of spaced-apart fasteners structured to attach said cladding element to the building wall element, one of said fasteners passing through said shaped profile strip and into the building wall element, and a lip profile enveloping a lower corner of said cladding element, said lip profile being provided with a subtending leg, guided in a plane parallel to said major faces between vertical walls of said shaped profile strip.

* * * * *